US006436598B1

(12) United States Patent
Honma et al.

(10) Patent No.: US 6,436,598 B1
(45) Date of Patent: Aug. 20, 2002

(54) POLYMERIZATION TONER AND PROCESS FOR PRODUCING THE SAME

(75) Inventors: Akira Honma; Takahiro Takasaki, both of Kanagawa (JP)

(73) Assignee: Nippon Zeon Co., Ltd., Tokyo (JP)

( * ) Notice: Subject to any disclaimer, the term of this patent is extended or adjusted under 35 U.S.C. 154(b) by 0 days.

(21) Appl. No.: 09/700,266

(22) PCT Filed: May 12, 1999

(86) PCT No.: PCT/JP99/02453

§ 371 (c)(1),
(2), (4) Date: Nov. 9, 2000

(87) PCT Pub. No.: WO99/59032

PCT Pub. Date: Nov. 18, 1999

(30) Foreign Application Priority Data

May 12, 1998 (JP) ..... 10-146641

(51) Int. Cl.[7] ..... G03G 9/087

(52) U.S. Cl. ..... 430/108.8; 430/109.4; 430/111.4; 430/137.17

(58) Field of Search ..... 430/137.17, 109.3, 430/109.4, 108.8, 111.4

(56) References Cited

U.S. PATENT DOCUMENTS

| | | | | |
|---|---|---|---|---|
| 4,601,968 A | | 7/1986 | Hyosu | 430/137 |
| 4,626,489 A | | 12/1986 | Hyosu | 430/137 |
| 5,185,229 A | | 2/1993 | Sato et al. | 430/110 |
| 6,002,903 A | * | 12/1999 | Hayase et al. | 430/109.3 |

FOREIGN PATENT DOCUMENTS

| | | |
|---|---|---|
| JP | 57-45558 | 3/1982 |
| JP | 59-62870 | 4/1984 |
| JP | 1-142557 | 6/1989 |
| JP | 1-257854 | 10/1989 |
| JP | 2-259657 | 10/1990 |
| JP | 3-203746 | 9/1991 |
| JP | 3-215870 | 9/1991 |
| JP | 7-13764 | 2/1995 |
| JP | 7-78646 | 8/1995 |
| JP | 8-314186 | 11/1996 |
| JP | 9-230630 | 9/1997 |

* cited by examiner

*Primary Examiner*—John Goodrow
(74) *Attorney, Agent, or Firm*—Dinsmore & Shohl LLP

(57) ABSTRACT

A polymerized toner of a core-shell structure that colored polymer particles containing a colorant are covered with a polymer layer, wherein the polymerized toner has features that (1) the content of tetrahydrofuran-insoluble matter is 60 to 95 wt. %, and (2) the weight average molecular weight of tetrahydrofuran-soluble matter as determined by gel permeation chromatography is 50,000 to 400,000, and a production process thereof.

22 Claims, No Drawings

POLYMERIZATION TONER AND PROCESS FOR PRODUCING THE SAME

TECHNICAL FIELD

The present invention relates to a polymerized toner and a production process thereof, and more particularly to a polymerized toner of a core-shell structure, which is suitable for use in developing an electrostatic latent image formed by an electrophotographic process, electrostatic recording process or the like, and a production process thereof.

BACKGROUND ART

In an image forming apparatus such as an electrophotographic apparatus or electrostatic recording apparatus, an electrostatic latent image formed on a photosensitive member has heretofore been developed with a developer. After the developer image formed by the development is transferred to a transfer medium such as paper as needed, the unfixed image is fixed by any of various methods such as heating, pressing and use of solvent vapor. As the developer, a toner is used either singly or in combination with carrier particles and/or a flowability improver. The toner means colored particles obtained by dispersing a colorant such as carbon black and other additives in a binder resin. Processes for producing a toner are roughly divided into a grinding process and a polymerization process.

In the grinding process, a thermoplastic resin, a colorant, a charge control agent, a parting agent and the like are melted and mixed into a resin composition, and the resin composition is ground and then classified, thereby producing a toner having a desired particle diameter. According to the grinding process, a toner having a measure of excellent properties can be produced. However, the grinding process involves important problems.

First, in the grinding process, there is a limit to the selection of materials for the toner for the purpose of ensuring a high toner yield. Second, in the grinding process, it is difficult to uniformly disperse solid fine particles such as the colorant, charge control agent and parting agent in the thermoplastic resin. Therefore, good flowability, triboelectrification properties and the like for the resulting toner cannot be achieved to deteriorate properties of the toner, such as developing characteristics and durability. Third, in order to improve the fixing ability of the resulting toner so as to meet high-speed copying and formation of full-color images, it is necessary to lower the glass transition temperature of the toner. When a thermoplastic resin having a low glass transition temperature is used, however, difficulty is encountered on the grinding of the resulting resin composition. Therefore, the glass transition temperature of the toner cannot be lowered to 60° C. or lower. It is hence difficult to provide a toner improved in fixing ability by the grinding process.

In order to overcome these problems in the grinding process, processes of producing a toner (polymerized toner) by suspension polymerization have been proposed in recent years. In the suspension polymerization process, solid fine particles such as a colorant, a charge control agent and a parting agent are added to a polymerizable monomer, which is a low-viscosity liquid, to disperse them therein. Therefore, a satisfactory, uniformly dispersing quality can be ensured compared with the grinding process. According to the suspension polymerization process, polymer particles (toner) having a desired particle diameter and a narrow particle diameter distribution can be generally obtained at a yield as high as at least 90%, and so such a process has an economical advantage over the grinding process. Further, the glass transition temperature of the polymerized toner can be adjusted by selecting the kinds and combination of polymerizable monomers. As described above, the problems involved in the grinding process can be solved by the use of the suspension polymerization process. However, the conventional polymerized toners have not come to fully meet the level of requirements for toners in recent years.

Copying machines, printers and the like of the electrophotographic system have been recently required to reduce demand power and to achieve the speeding-up of copying or printing. A step in which energy is particularly demanded in the electrophotographic system is a fixing step conducted after transferring a toner image from a photosensitive member to a transfer medium such as transfer paper. In the fixing step, the toner is fixed to the transfer medium by heating and melting it. Therefore, a heating roll heated to a temperature of at least 150° C. is used, and electric power is used as an energy source therefor. There is a demand for lowering the temperature of the heating roll from the viewpoint of energy saving. In order to lower the temperature of the heating roll, it is necessary to make a toner fixable at a temperature lower than that heretofore used. Namely, it is necessary to lower the fixing temperature of the toner itself. Besides, the speeding-up of copying and printing has been strongly required with the advancement of the combination of image forming apparatus and the formation of personal computer network. In order to realize high-speed copying machines and high-speed printers, it is necessary to conduct fixing in a shorter time than before. If the fixing temperature of a toner can be lowered, it is also possible to shorten the fixing time by controlling the temperature of a heating roll. Therefore, the lowering of the fixing temperature of the toner also can meet the speeding-up of copying and printing.

In order to meet requirements of energy saving, high-speed copying and the like from an image forming apparatus in the design of a toner, it is only necessary to lower a glass transition temperature of a binder resin (polymer component) making up the toner. When a toner is made up of a binder resin having a low glass transition temperature, however, the toner becomes poor in the so-called shelf stability because particles themselves of the toner tend to undergo blocking during storage or shipment, or in a toner box of an image forming apparatus, to aggregate.

In order to permit formation of bright images in color copying or color printing by the electrophotographic system, the mere melting and softening of toners to fusion-bond the toners to a transfer medium are not enough, but it is necessary to uniformly melt and mix the toners of different colors to mix their colors. More specifically, in the color copying or color printing, development is generally conducted with color toners of 3 or 4 different colors to transfer the resulting toner image to a transfer medium at a time or by 3 or 4 installments, and the toner image is then fixed. Therefore, the thickness of the toner layer to be fixed becomes thicker compared with a black-and-white image. In fixing of such color toners, the respective color toners overlapped are required to be uniformly melted, and so the melt viscosity of each toner at about the fixing temperature thereof must be designed low compared with the conventional toners. Means for lowering the melt viscosity of the toner include, for example, methods in which the molecular weight of a resin used is made lower compared with the resins for the conventional toners, and in which the glass transition temperature thereof is lowered. In any of these methods, however, the toner becomes poor in shelf stability because the toner tends to undergo blocking.

As described above, there is an adverse correlation between the means for coping with the lowering of the fixing temperature of a toner, the speeding-up of printing and the formation of color images, and the shelf stability (blocking resistance) of the toner. As means for solving this adverse correlation, various proposals have heretofore been made. Of these, there has been proposed a toner of a core-shell structure (also referred to as a capsule toner), in which individual colored polymer particles (core) having a low glass transition temperature are coated with a polymer having a high glass transition temperature. However, the conventional means have involved many problems to be solved.

For example, Japanese Patent Application Laid-Open No. 45558/1982 has proposed a process for producing a toner for development of electrostatic images, in which core particles obtained by polymerization are mixed and dispersed in an aqueous latex solution, and a water-soluble inorganic salt is then added to the solution, or the pH of the solution is changed, thereby forming a coating layer composed of fine particles obtained by emulsion polymerization on each surface the core particles. However, the toner obtained by this process has involved a drawback that the environmental dependence of charge properties of the toner becomes great due to the influence of the surfactant and inorganic salt remaining on the fine particles, and in particular, charging is deteriorated under high-temperature and high-humidity conditions.

Japanese Patent Application Laid-Open No. 62870/1984 discloses a process for producing a toner excellent in shelf stability and thermal fixing ability by adopting a polymerization process comprising suspension-polymerizing a toner material containing a monomer, a polymerization initiator and a colorant to form polymer particles and dropping a monomer capable of providing a polymer having a glass transition temperature higher than that of the polymer particles on the polymer particles to cause such a monomer to be adsorbed on the polymer particles to grow it. However, this process is required to increase the proportion of the monomer added dropwise to the polymer particles to a considerable extent. If the proportion of the monomer added dropwise is too high, the shell formed of a layer of the polymer having a higher glass transition temperature becomes too thick, so that the fixing temperature of the resulting toner cannot be fully lowered. Even when low-melting point wax is contained in the polymer particles (core) of the toner having such a structure for improving the fixing ability, only a tone narrow in fixing margin can be provided because a difference between the fixing temperature and the offset temperature lessens.

On the other hand, in a fixing system by pressing and heating making use of a heating roll, a part of a toner image adheres to the surface of the fixing roll because the surface of the heating roll comes into contact under pressure with the toner image in a molten state, so that an offset phenomenon is easy to occur. Therefore, various improvements have been attempted to provide having enhanced offset resistance and a low fixing temperature.

For example, Japanese Patent Application Laid-Open No. 142557/1989 has proposed a capsule toner comprising an inner core containing a resin having a molecular weight of 5,000 to 50,000 and a softening point of 70 to 160° C., a skin containing a resin having a molecular weight of 30,000 to 200,000, a softening point of not lower than 130° C. and a thickness of at most 3 $\mu$m, and a colored layer provided between the core and the shell and having a colorant content of 10 to 30% for the purpose of calling for improvements of fixing property at a low temperature and image quality. However, when the softening point of the inner core is 70 to 160° C., such a toner fails in fixing at a sufficiently low temperature. In addition, the molecular weight of the resin component is low, and so an offset temperature is also low, so that a fixing temperature range becomes narrow.

Japanese Patent Application Laid-Open No. 257854/1989 has proposed a toner comprising fine particles applied and fixed to each surface of core particles for the purpose of calling for good triboelectrification properties and high light transmission property capable of color-overlapping in a color image of the toner, wherein the core particles have a softening point of at most 150° C., a number average molecular weight of 3,000 to 15,000, a ratio of weight average molecular weight/number average molecular weight of at most 3, the fine particles have a glass transition point of at least 55° C. and a softening point of at most 150° C. However, this toner cannot satisfactorily meet offset resistance and low-temperature fixing ability.

Japanese Patent Publication No. 13764/1995 has proposed a toner for development of electrostatic images, comprising a vinyl polymer having at least 1 wt. % of an A component which contains 0.1 to 60 wt. % of a gel component, has a main peak in a molecular weight range of 1,000 to 25,000 and at least one subpeak or subshoulder in a molecular weight range of 3,000 to 150,000 in a chromatograph of tetrahydrofuran-soluble matter by gel permeation chromatography (GPC) and falls within a molecular weight range of at least 500,000, 10 to 60 wt. % of a B component which falls within a molecular weight range of 30,000 to 500,000 and 20 to 90 wt. % of a C component which falls within a molecular weight range of at most 30,000.

Japanese Patent Publication No. 78646/1995 has proposed a toner for development of electrostatic images, comprising a binder resin and a colorant, wherein the binder resin contains 10 to 60 wt. % of tetrahydrofuran-insoluble matter, the molecular weight distribution of tetrahydrofuran-soluble matter by GPC in the binder resin is at most 5, and the binder resin contains 10 to 50 wt. % of a component having at least one peak within a molecular weight range of 2,000 to 10,000, at least one peak or shoulder within a molecular weight range of 15,000 to 100,000 and a molecular weight of at most 10,000.

The toners described in Japanese Patent Publication Nos. 13764/1995 and 78646/1995 are said to be suitable for use in a fixing system by a heating roll. However, since the molecular weight of the polymer component (binder resin) is low, the offset resistance is insufficient. The toners specifically described in these publications are those obtained by the grinding process and hence include various problems attendant on the grinding process. Further, since these toners art not of a capsule type, the blocking resistance (shelf stability) thereof is insufficient.

As described above, various researches have heretofore been made laying stress on production processes of toners, and there has not been obtained under the circumstances any toner for development of electrostatic images, which is capable of conducting fixing at a low temperature, has excellent offset resistance and shelf stability and can be practically used as a color toner.

DISCLOSURE OF THE INVENTION

It is an object of the present invention to provide a toner for development of electrostatic images, which is excellent in low-temperature fixing ability, offset resistance and shelf stability, in accordance with the polymerization process.

More specifically, the object of the present invention is to provide a toner for development of electrostatic images, which has a low fixing temperature, can meet the speeding-up of printing, is suitable for use as a color toner, and has a high offset temperature and excellent shelf stability, and a production process thereof.

The present inventors have carried out an extensive investigation with a view toward overcoming the above-described problems involved in the prior art. As a result, it has been found that the above object can be achieved by providing a polymerized toner of a core-shell structure, comprising colored polymer particles as core particles, in which a colorant is dispersed in a binder resin, and a polymer layer which covers each surface of the colored polymer particles, wherein the polymerized toner contains tetrahydrofuran-insoluble matter in a high proportion, and the weight average molecular weight of tetrahydrofuran-soluble matter in the toner falls within a specific range.

This polymerized toner can be produced by forming fine droplets of a monomer composition for core, which contains at least a polymerizable monomer for core and a colorant, in an aqueous dispersion medium containing a dispersion stabilizer, subjecting the monomer composition to suspension polymerization in the presence of a polymerization initiator to form colored polymer particles and then subjecting a polymerizable monomer for shell to suspension polymerization in the presence of the colored polymer particles, thereby forming a polymer layer which covers each of the colored polymer particles (A). Upon the suspension polymerization, the formulation of the monomer composition for core which may contain a crosslinkable monomer, a molecular weight modifier, etc., and moreover conditions for the formation of the droplets, and the polymerization, and the like are controlled, whereby a polymerized toner of a core-shell structure having the desired properties can be produced.

The present invention has been led to completion on the basis of these finding.

According to the present invention, there is thus provided a polymerized toner of a core-shell structure that colored polymer particles (A) containing a colorant are covered with a polymer layer (B), wherein the polymerized toner has the following features:

(1) the content of tetrahydrofuran-insoluble matter being 60 to 95 wt. %; and (2) the weight average molecular weight of tetrahydrofuran-soluble matter as determined by gel permeation chromatography being 50,000 to 400,000.

According to the present invention, there is also provided a process for producing a polymerized toner of a core-shell structure that colored polymer particles (A) containing a colorant are covered with a polymer layer (B), said process comprising the steps of forming fine droplets of a monomer composition for core, which contains at least a polymerizable monomer for core and a colorant, in an aqueous dispersion medium containing a dispersion stabilizer, subjecting the monomer composition to suspension polymerization in the presence of a polymerization initiator to form the colored polymer particles (A) and then subjecting a polymerizable monomer for shell to suspension polymerization in the presence of the colored polymer particles (A) to form the polymer layer (B) which covers each of the colored polymer particles (A), thereby forming polymer particles having a core-shell structure, which have the following features:

(1) the content of tetrahydrofuran-insoluble matter being 60 to 95 wt. %; and (2) the weight average molecular weight of tetrahydrofuran-soluble matter as determined by gel permeation chromatography being 50,000 to 400,000.

BEST MODE FOR CARRYING OUT THE INVENTION

Polymerized Toner of Core-shell Structure

The polymerized toner according to the present invention has a core-shell structure that colored polymer particles (A) containing a colorant are covered with a polymer layer (B), and the feature thereof resides in that the content of tetrahydrofuran- (hereinafter abbreviated as THF)-insoluble matter and the weight average molecular weight of THF-soluble matter both fall within respective specific ranges. The determining methods of the content of the THF-insoluble matter and the molecular weight of the THF-soluble matter will be described subsequently.

The polymerized toner according to the present invention can be obtained by forming fine droplets of a monomer composition for core, which contains at least a polymerizable monomer and a colorant, in an aqueous dispersion medium containing a dispersion stabilizer, subjecting the monomer composition to suspension polymerization using a polymerization initiator to form colored polymer particles for core and then subjecting a polymerizable monomer for shell to suspension polymerization.

1. Content of THF-insoluble Matter

The content of the THF-insoluble matter (hereinafter may be referred to as "gel content") of the polymerized toner is determined as a proportion (%) of insoluble matter which is not extracted with a solvent, THF, when the toner is extracted by means of a Soxhlet extractor by using THF as an extraction solvent. However, the proportion of the insoluble matter is calculated out to the exclusion of components originally insoluble in the solvent, such as a pigment.

In the polymerized toner according to the present invention, the content of the THF-insoluble matter is 60 to 95 wt. %, preferably higher than 60 wt. %, but not higher than 90 wt. %. If the content of the THF-insoluble matter is too low, the offset temperature (temperature of a fixing roll, at which an offset phenomenon occurs) of the toner becomes too low upon fixing by a heating roll (fixing roll), and so the toner tends to cause offset. If the content of the THF-insoluble matter is too high on the other hand, the fixing temperature of the toner becomes high, and so the low-temperature fixing ability of the toner is deteriorated.

2. Weight Average Molecular Weight of THF-soluble Matter

The weight average molecular weight in the polymerized toner according to the present invention is 50,000 to 400,000, preferably 100,000 to 350,000, more preferably 150,000 to 300,000 in a chromatogram of the THF-soluble matter by GPC.

If the weight average molecular weight the THF-soluble matter is too low, the offset temperature of the toner becomes too low, and so the toner tends to cause offset upon fixing. If the weight average molecular weight the THF-soluble matter is too high on the other hand, the low-temperature fixing ability of the toner is deteriorated.

Raw Material of Polymerized Toner

In the polymerized toner of the core-shell structure according to the present invention, a monomer composition containing at least a polymerizable monomer and a colorant is used as a raw material. Besides these components, various components, for example, a crosslinkable monomer, a macromonomer, a charge control agent, a parting agent, a molecular weight modifier, a lubricant, a dispersion aid, etc. may be contained in the monomer composition. The monomer composition is subjected to suspension polymerization in the presence of a polymerization initiator, thereby forming colored polymer particles (A) which will become core particles. The polymer layer (B) which will become a shell is formed by using a polymerizable monomer for shell and subjecting it to suspension polymerization in the presence of the colored polymer particles (A). The typical component of the raw material will hereinafter be described. However, other additives than these components, and the like may be used as optional components as needed.

1. Polymerizable Monomer for Core

In the present invention, vinyl monomer(s) are generally used as polymerizable monomer(s) for core. Various kinds of vinyl monomers may be used either singly or in any combination thereof, whereby the glass transition temperature (Tg) of a polymer component (binder polymer) in the colored polymer particles (A) can be controlled within the desired range.

Examples of the vinyl monomers used in the present invention include styrenic monomers such as styrene, vinyltoluene and a-methylstyrene; acrylic acid and methacrylic acid; derivatives of (meth)acrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinylpyrrolidone. These vinyl monomers may be used either singly or in any combination thereof.

Among these, combinations of a styrenic monomer with a derivative of (meth)acrylic acid are preferably used. As specific preferable examples thereof, may be mentioned combinations of styrene with n-butyl acrylate, and styrene with 2-ethylhexyl acrylate.

The polymerizable monomer for core used in the present invention is preferably such that can form a polymer having a glass transition temperature (Tg) of generally at most 60° C., preferably 20 to 60° C., more preferably 40 to 60° C. for the purpose of lowering the fixing temperature of the resulting toner. In the polymerized toner of the core- shell structure, Tg of a polymer component forming colored polymer particles which will become core particles is made lower than that of a polymer component which forms a shell, whereby the fixing temperature of the resulting toner can be lowered, and moreover the shelf stability (blocking resistance) can be enhanced. A difference in Tg between the respective polymer components which form the core and shell is relative.

If Tg of the polymer component forming colored polymer particles which will become core particles is too high, it is difficult to fully lower the fixing temperature of the resulting polymerized toner, resulting in a failure to satisfactorily meet the speeding-up of copying or printing, the formation of full-color images, and the like. If the Tg is too low, the shelf stability of the resulting polymerized toner becomes liable to be deteriorated even when a shell is formed on each surface of such polymer particles. The Tg is most preferably within a range of 50 to 60° C. If the polymerizable monomer for core is a monomer capable of forming a polymer having a too high glass transition temperature, the resulting polymerized toner comes to have a higher fixing temperature, can not meet the speeding-up of copying or printing and provides images deteriorated in permeability through OHP.

The Tg of the polymer is a calculated value (referred to as calculated Tg) calculated out according to the kind(s) and proportion(s) of monomer(s) used. When the polymerizable monomer used is one, the Tg of a homopolymer formed from this monomer is defined as Tg of the polymer in the present invention. For example, the Tg of polystyrene is 373K. Therefore, when styrene is used as a monomer by itself, the monomer can be said to form a polymer having a Tg of 100° C. (373K). When monomers used are two or more, and the polymer formed is a copolymer, the Tg of the copolymer is calculated out according to the kinds and proportions of the monomers used in accordance with the following equation:

$$100/\mathrm{Tg}=W_1/T_1+W_2/T_2+W_3/T_3+\ldots W_n/T_n$$

wherein

Tg: the glass transition temperature of the (co)polymer (absolute temperature), $W_1, W_2, W_3 \ldots W_n$: % by weight of respective monomers (n means the number of monomers used)

$T_1, T_2, T_3 \ldots T_n$: glass transition temperature (absolute temperature) of a homopolymer formed from each of the monomers (n means the number of monomers used).

2. Crosslinkable Monomer

A crosslinkable monomer is preferably used together with the polymerizable monomer from the viewpoints of controlling the content of the THF-soluble matter within the desired range, preventing offset (particularly, hot offset) of the polymerized toner and further improving the shelf stability (blocking resistance) of the polymerized toner. The crosslinkable monomer is a compound having two or more polymerizable carbon-carbon unsaturated double bonds.

As example of the crosslinkable monomer, may be mentioned aromatic divinyl compounds such as divinylbenzene, divinylnaphthalene and derivatives thereof; ethylenically unsaturated carboxylic acid esters such as ethylene glycol dimethacrylate and diethylene glycol dimethacrylate; divinyl compounds such as N,N-divinylaniline and divinyl ether; and compounds having three or more vinyl groups.

These crosslinkable monomers may be used either singly or in any combination thereof. These crosslinkable monomers are used in a proportion of generally at most 5 parts by weight, preferably 0.1 to 3 parts by weight, more preferably 0.3 to 2 parts by weight per 100 parts by weight of the polymerizable monomer for core. The proportion of the crosslinkable monomer used varies according to the kind of the polymerizable monomer for core used, and the like, and about 0.4 to 1.0 part by weight per 100 parts by weight of the polymerizable monomer for core suffices in many cases for achievement of the gel content within the above-described range. If the proportion of the crosslinkable monomer used is too low, any satisfactory gel content cannot be achieved. If the proportion is too high on the other hand, the gel content becomes too high, and hard core particles are formed. In both cases, it is hence difficult to provide a good polymerized toner. A high-molecular weight crosslinking agent is generally expensive, and has a tendency to make it difficult to finely adjust the gel content within the desired range.

3. Macromonomer

A macromonomer is preferably used together with the polymerizable monomer for the purpose of improving a balance among the shelf stability, offset resistance and low-temperature fixing ability of the polymerized toner.

The macromonomer (also referred to as a macromer) is a relatively long-chain linear molecule having a polymerizable functional group (for example, a group containing an unsaturated bond such as a carbon-carbon double bond) at its molecular chain terminal. The macromonomer is preferably an oligomer or polymer having a polymerizable vinyl functional group at its molecular chain terminal and a number average molecular weight of about 1,000 to 30,000. If the number average molecular weight of the macromonomer is too low, the surface part of the resulting polymerized toner becomes soft, and hence shows a tendency to deteriorate its shelf stability. If a macromonomer having a too high number average molecular weight is used, the melt properties of the macromonomer itself becomes poor, resulting in a polymerized toner deteriorated in low-temperature fixing ability and shelf stability. As examples of the polymerizable vinyl functional group that the macromonomer has at its molecular chain terminal, may be mentioned an acryloyl group and a methacryloyl group, with the methacryloyl group being preferred from the viewpoint of easy copolymerization.

The macromonomer used in the present invention preferably has a glass transition temperature (Tg) higher than that of a polymer obtained by polymerizing the polymerizable monomer for core. However, a difference in Tg between the polymer obtained by polymerizing the polymerizable monomer for core and the macromonomer is relative. Tg is a value measured by means of an ordinary measuring device such as a differential scanning calorimeter (DSC). The Tg of the macromonomer used in the present invention is preferably at least 80° C., more preferably 80 to 110° C., particularly preferably 85 to 105° C.

As examples of the macromonomer used in the present invention, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton; and those disclosed in Japanese Patent Application Laid-Open No. 203746/1991. Among these macromonomers, hydrophilic macromonomers, in particular, polymers obtained by polymerizing methacrylic esters or acrylic esters either singly or in combination of two or more monomers thereof are particularly preferred.

The proportion of the macromonomer used is generally 0.01 to 1 part by weight, preferably 0.03 to 0.8 parts by weight per 100 parts by weight of the polymerizable monomer for core. If the proportion of the macromonomer used is too low, the resulting polymerized toner shows a tendency not to improve the shelf stability and offset resistance thereof. If the proportion of the macromonomer used is too high on the other hand, the resulting polymerized toner shows a tendency to deteriorate its fixing ability.

4. Colorant

In the present invention, a colorant is used for the purpose of providing a polymerized toner. The colorant is contained in the colored polymer particles (A) forming the core. As carbon black representative of the colorant, is preferred that having a primary particle diameter of 20 to 40 nm. If the primary particle diameter of the carbon black is too small, the dispersibility thereof is deteriorated. If the primary particle diameter is too great on the other hand, the content of polycyclic aromatic hydrocarbons in the resulting polymerized toner becomes high, resulting in a possibility that a problem of safety may arise.

As examples of a black colorant used in the present invention, may be mentioned dyes and pigment such as carbon black and Nigrosine Base; and magnetic particles such as cobalt, nickel, diiron trioxide, triiron tetroxide, manganese iron oxide, zinc iron oxide and nickel iron oxide.

Examples of colorant for color toners include Naphthol Yellow S, Hansa Yellow G, C.I. Pigment Yellow, C.I. vat Yellow, eosine lake, C.I. Pigment Red, C.I. Pigment Violet, C.I. Vat Red, Phthalocyanine Blue, C.I. Pigment Blue, C.I. Vat Blue and C.I. Acid Blue.

The dyes or pigments are used in a proportion of generally 0.1 to 20 parts by weight, preferably 1 to 10 parts by weight per 100 parts by weight of the polymerizable monomer for core. The magnetic particles are used in a proportion of generally 1 to 100 parts by weight, preferably 5 to 50 parts by weight per 100 parts by weight of the polymerizable monomer for core.

5. Charge Control Agent

In the present invention, various kinds of charge control agents having positively charging ability or negatively charging ability may be used for the purpose of improving the charge properties of the resulting polymerized toner. Examples of the charge control agents include metal complexes of organic compounds having a carboxyl group or a nitrogen-containing group, metallized dyes and nigrosine. More specifically, may be mentioned Bontron NO1 (nigrosine, product of Orient Chemical Industries Ltd.), Bontron EX (nigrosine, product of Orient Chemical Industries Ltd.), Spiron Black TRH (product of Hodogaya Chemical Co., Ltd.), T-77 (product of Hodogaya Chemical Co., Ltd.), Bontron S-34 (product of Orient Chemical Industries Ltd.), Bontron E-84 (product of Orient Chemical Industries Ltd.), Copy Blue-PR (product of Hoechst AG), and charge control resins such as quaternary ammonium salt-containing resins and sulfonic group-containing resins. The charge control agent is used in a proportion of generally 0.01 to 10 parts by weight, preferably 0.03 to 5 parts by weight per 100 parts by weight of the polymerizable monomer for core.

6. Parting Agent

In the present invention, a parting agent is preferably used for the purpose of improving the parting ability of the resulting polymerized toner. As examples of the parting agent, may be mentioned polyfunctional ester compounds such as pentaerythritol tetrastearate and pentaerythritol tetrastearate; low molecular weight polyolefins such as low molecular weight polyethylene, low molecular weight polypropylene and low molecular weight polybutylene; paraffin waxes which are waxes occurred in nature; and synthetic waxes such as Fischer-Tropsch wax. Among these parting agents, those having a melting point of 50 to 110° C. are preferred. Fischer-Tropsch wax which is a synthetic wax is particularly preferred. The parting agent is used in a proportion of generally 0.1 to 20 parts by weight, preferably 0.5 to 10 parts by weight per 100 parts by weight of the polymerizable monomer for core. The use of the parting agent permits the improvement of low-temperature fixing ability. If the proportion of the parting agent used is too low, the effect of improving the low-temperature fixing ability becomes little. If the proportion is too high, the shelf stability of the resulting polymerized toner is deteriorated.

7. Molecular Weight Modifier

In the present invention, a molecular weight modifier is preferably used for the purpose of, for example, adjusting the weight average molecular weight of a THF-soluble matter in the resulting polymerized toner. Examples of the molecular weight modifier include mercaptans such as t-dodecylmercaptan, n-dodecylmercaptan and n-octylmercaptan; and halogenated hydrocarbons such as carbon tetrachloride and carbon tetrabromide. These molecular weight modifiers are generally contained in the polymerizable monomer for core before the initiation of the polymerization. However, they may be added into the reaction system in the course of the polymerization of the monomer composition for core if desired. The proportion of the molecular weight modifier used is generally 0.01 to 10 parts by weight, preferably 0.1 to 5 parts by weight per 100 parts by weight of the polymerizable monomer for core. The addition of the molecular weight modifier makes it easy to control the weight average molecular weight of the THF-soluble matter within the desired range.

8. Lubricant and Dispersion Aid

In the present invention, any of various kinds of lubricants such as oleic acid, stearic acid, various waxes, and olefinic lubricants such as polyethylene and polypropylene; a dispersion aid such as a silane or titanium coupling agent; and/or the like may be used for the purpose of, for example, improving the uniformly dispersing ability of the colorant in the polymerizable monomer for core or the resulting polymerized toner. Such a lubricant or dispersant is generally used in a proportion of about 1/1,000 to 1/1 based on the weight of the colorant.

9. Polymerization Initiator for Core

In the present invention, fine droplets of a monomer composition for core, which contains at least a polymerizable monomer and a colorant, are formed in an aqueous dispersion medium containing a dispersion stabilizer, and the monomer composition is then subjected to suspension polymerization in the presence of a polymerization initiator to prepare colored polymer particles.

A radical polymerization initiator is generally used as the polymerization initiator for core. As examples of the radical polymerization initiator, may be mentioned persulfates such as potassium persulfate and ammonium persulfate; azo compounds such as 4,4'-azobis(4-cyanovaleric acid), dimethyl-2,2'-azobis(2-methyl propionate), 2,2'-azobis(2-amidinopropane) bihydrochloride, 2,2'-azobis-2-methyl-N-1,1-bis(hydroxymethyl)-2-hydroxy-ethylpropionamide, 2,2'-azobis(2,4-dimethylvaleronitrile), 2,2'-azobisisobutyronitrile and 1,1'-azobis(1-cyclohexane-carbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropyl peroxydicarbonate and di-t-butyl peroxyisophthalate. Redox initiators composed of combinations of these polymerization initiators with a reducing agent may also be used.

Among these radical polymerization initiators, oil-soluble radical initiators are preferred, with oil-soluble radical initiators selected from among organic peroxides whose decomposition temperature giving a half-life period of 10 hours are 60 to 80° C., preferably 65 to 80° C. and whose molecular weights are 250 or lower being particularly preferred. Among the oil-soluble radical initiators, t-butyl peroxy-2-ethylhexanoate is particularly preferred because the resulting polymerized toner scarcely gives odor upon printing and barely causes environmental destruction by volatile components such as odor.

The proportion of the polymerization initiator used is generally 0.01 to 20 parts by weight, preferably 0.1 to 10 parts by weight per 100 parts by weight of the polymerizable monomer for core. Alternatively, the proportion of the polymerization initiator used is generally 0.001 to 5 wt. % based on the aqueous dispersion medium. If the proportion of the polymerization initiator used is too low, the rate of polymerization becomes slow. Any too high proportion is not economical.

The polymerization initiator may be contained in a monomer composition for core in the step of preparing the monomer composition. In order to prevent premature polymerization, however, it is preferable to mix the components other than the polymerization initiator to prepare a monomer composition for core, pour the monomer composition into an aqueous dispersion medium containing a dispersion stabilizer and then add the oil-soluble polymerization initiator while stirring the resultant dispersion. The polymerization initiator poured into the aqueous dispersion medium comes into contact with droplets of the monomer composition for core to migrate into the droplets. High shearing force is then applied to the aqueous dispersion medium to disperse the droplets, thereby forming fine droplets corresponding to the intended particle diameter and particle diameter distribution of the resulting polymerized toner.

10. Dispersion Stabilizer

The monomer composition for core containing a polymerizable monomer for core and a colorant, and optionally various kinds of additives is poured into an aqueous dispersion medium containing a dispersion stabilizer to form fine droplets.

The dispersion stabilizer used in the present invention is preferably colloid of a hardly water-soluble metallic compound. As examples of the hardly water-soluble metallic compound, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide. Among these, colloids of hardly water-soluble metal hydroxides are preferred because the droplet and particle diameter distributions of the fine droplets of the monomer composition for core and the resulting colored polymer particles can be narrowed, and the brightness or sharpness of an image formed from such a polymerized toner is enhanced.

These colloids adhere to each surface of the fine droplets of the monomer composition for core and colored polymer particle formed to form a protective layer. Therefore, the use of these colloids is preferred from the viewpoint of stably providing colored polymer particles having the desired particle diameter and particle diameter distribution and properly shaped into sphere.

The colloids of the hardly water-soluble metal hydroxides are not limited by the production process thereof. However, such colloid can preferably be prepared by adjusting the pH of an aqueous solution of a water-soluble polyvalent metallic compound to 7 or higher, whereby an aqueous dispersion medium containing the colloid of the hardly water-soluble metal hydroxide can be obtained. The adjustment of the pH is generally conducted with an aqueous solution of an alkali metal hydroxide. Accordingly, the colloid of the hardly water-soluble metal hydroxide is preferably colloid of a hardly water-soluble metal hydroxide formed by reacting a water-soluble polyvalent metallic compound with an alkali metal hydroxide in an aqueous phase. Examples of the water-soluble polyvalent metallic compound include the hydrochlorides, carbonates, sulfates, nitrates and acetates of polyvalent metals such as magnesium, calcium, aluminum, iron, copper, manganese, nickel and tin. Examples of the alkali metal hydroxide include sodium hydroxide and potassium hydroxide. Aqueous ammonia may be used in combination for the purpose of adjusting the pH.

The colloid of the hardly water-soluble metallic compound used in the present invention preferably has number particle diameter distributions, $D_{50}$ (50% cumulative value of number particle diameter distribution) of at most 0.5 μm and $D_{90}$ (90% cumulative value of number particle diameter distribution) of at most 1 μm. If the particle diameter of the colloid is too great, the stability of the polymerization reaction system is broken, and the resulting polymerized toner also shows a tendency to deteriorate its shelf stability. The dispersion stabilizer is used in a proportion of generally 0.1 to 20 parts by weight per 100 parts by weight of the polymerizable monomer for core. If the proportion of the dispersion stabilizer used is too low, it is difficult to achieve sufficient polymerization stability, so that polymer aggregates are liable to form. If the proportion of the dispersion stabilizer used is too high on the other hand, the viscosity of the aqueous dispersion medium is increased. It is hence not preferable to use the dispersion stabilizer in such a too low or high proportion.

In the present invention, a dispersion stabilizer containing a water-soluble polymer may be used as needed. As examples of the water-soluble polymer, may be mentioned polyvinyl alcohol, methyl cellulose and gelatin. In the present invention, there is no need to use any surfactant. However, a surfactant may be added for the purpose of stably conducting the polymerization so far as the environmental dependence of the charge properties of the resulting polymerized toner does not become high. The combined use of the above-described colloid with the surfactant makes it easy to form uniform droplets of the monomer composition for core.

11. Polymerizable Monomer for Shell

The polymerizable monomer for shell used in the present invention is such that can form a polymer having a Tg higher than that of the polymer component forming the colored polymer particles (A) as the core. More specifically, as the polymerizable monomer for shell, monomers capable of forming a polymer having a Tg of 80° C. or higher, such as styrene and methyl methacrylate, are particularly preferably used either singly or in combination of two or more monomers thereof. When the Tg of the polymer component forming the core is far lower than 60° C., the polymerizable monomer for shell may be such that forms a polymer having a Tg of 60° C. or lower. In order to improve the shelf stability of the resulting polymerized toner, the Tg of the polymer formed from the polymerizable monomer for shell is desirably preset within a range of preferably 50 to 120° C., more preferably 60 to 110° C., particularly preferably 80 to 105° C.

If the Tg of the polymer formed from the polymerizable monomer for shell is too low, the shelf stability of the resulting polymerized toner may be lowered in some cases even if such a Tg is higher than that of the polymer component forming the core. A difference in Tg between the polymer component forming the core and the polymer component forming the shell is desirably controlled to preferably at least 10° C., more preferably at least 20° C. As the polymerizable monomer for shell, one or more monomers are used, and a charge control agent may be added to the monomer(s) to use the mixture as a monomer composition. When the charge control agent is added, the charge properties of a polymer layer forming the shell are enhanced, and in its turn a polymerized toner of a core-shell structure having excellent charge properties can be obtained. As the charge control agent, may be used those mentioned above. The proportion of the charge control agent incorporated is generally 0.01 to 10 parts by weight, preferably 0.03 to 5 parts by weight per 100 parts by weight of the polymerizable monomer for shell. Other additives than the charge control agent may also be added to the polymerizable monomer for shell as needed.

In the polymerized toner of the core-shell structure according to the present invention, a weight ratio of the polymerizable monomer for core to the polymerizable monomer for shell is generally 80/20 to 99.9/0.1, preferably 80/20 to 99.7/0.3, more preferably 90/10 to 99.5/0.5. If the proportion of the polymerizable monomer for shell is too low, the effect of improving the shelf stability becomes little. If the proportion is too high on the other hand, the low-temperature fixing ability of the resulting polymerized toner is deteriorated.

12. Polymerization Initiator for Shell

In the present invention, the polymerizable monomer for shell is added to the reaction system in the presence of the colored polymer particles which will become core particles to conduct polymerization, thereby covering each surface of the colored polymer particles (core) with a polymer layer (shell). It is preferable to add a water-soluble radical initiator as a polymerization initiator to the reaction system at the time the polymerizable monomer for shell is added because a polymerized toner of a core-shell structure is easy to form. It is considered that when the water-soluble radical initiator is added, the water-soluble initiator enters in the vicinity of each surface of the core particles to which the polymerizable monomer for shell has migrated, so that the polymer layer is easy to be formed on the core particle surface.

As examples of the water-soluble radical initiator, may be mentioned persulfates such as potassium persulfate and ammonium persulfate; azo initiators such as 4,4'-azobis(4-cyanovaleric acid), 2,2'-azobis(2-amidinopropane) bihydrochloride and 2,2'-azobis-2-methyl-N-1,1-bis(hydroxymethyl)-2-hydroxyethylpropionamide; and combinations of an oil-soluble initiator such as cumene peroxide with a redox catalyst. The amount of the water-soluble radical initiator used is generally 1 to 70 parts by weight per 100 parts by weight of the polymerizable monomer for shell, or generally 0.01 to 10 wt. % based on the aqueous medium.

Production Process of Polymerized Toner

The production process of a polymerized toner of a core-shell structure according to the present invention is basically a process comprising forming fine droplets of a monomer composition for core, which contains at least a polymerizable monomer and a colorant, in an aqueous dispersion medium containing a dispersion stabilizer, subjecting the monomer composition to suspension polymerization in the presence of a polymerization initiator to form colored polymer particles and then adding a polymerizable monomer for shell to conduct polymerization in the presence of the colored polymer particles.

1. Step of Forming Droplets

The polymerizable monomer for core and the colorant, and optionally, various kinds of additives such as a crosslinkable monomer, a macromonomer, a dispersion aid, a charge control agent, a molecular weight modifier and a parting agent are mixed to uniformly disperse them by means of a ball mill or the like, thereby preparing an intimate liquid mixture (monomer composition for core). This liquid mixture is then poured into the aqueous medium containing the dispersion stabilizer to disperse it in the aqueous medium by means of a mixer having high shearing force, thereby forming fine droplets of the monomer composition for core. The kind and proportion of the crosslinkable monomer used, and the molecular weight modifier, parting agent and the like are suitably selected, thereby adjusting the content (gel content) of a THF-insoluble matter and the weight average molecular weight of a THF-soluble matter in the resulting polymerized toner so as to fall within the respective desired ranges.

No particular limitation is imposed on the time when the polymerization initiator (generally, the oil-soluble polymerization initiator) is added. However, it is preferably added to the aqueous dispersion medium before the formation of the fine droplets of the monomer composition for core is completed. The time when the polymerization initiator is added varies according to the intended particle diameter of the resulting polymerized toner, but is generally a point of time the volume average droplet diameter of primary droplets formed by the stirring of the monomer composition for core (liquid mixture) after pouring it has amounted to generally 50 to 1,000 μm, preferably 100 to 500 μm. The temperature of the aqueous dispersion medium from the addition of the polymerization initiator to the subsequent droplet-forming step, and further the addition to the polymerization reaction system is desirably regulated within a range of generally 10 to 40° C., preferably 20 to 30° C.

Accordingly, the phrase "after forming fine droplets of the monomer composition for core, the monomer composition is subjected to suspension polymerization in the presence of the polymerization initiator to form colored polymer particles (A)" in the present invention include the mode that the polymerization initiator is united with the droplets of the monomer composition for core in the droplet-forming step to migrate into fine droplets finally formed, and said polymerization initiator is used to conduct suspension polymerization, thereby forming colored polymer particles.

In the droplet-forming step, the above primary droplets are dispersed to secondary droplets having a droplet diameter and a droplet diameter distribution corresponding to the intended particle diameter and particle diameter distribution of the resulting polymerized toner to form fine droplets. The volume average droplet diameter (dv) of the fine particles of the monomer composition is generally about 0.1 to 20 μm, preferably about 0.5 to 15 μm, more preferably about 1 to 10 μm. If the droplet diameter of the droplets formed of the monomer composition for core is too great, the particle diameters of the colored polymer particles and polymerized toner become too great, so that the resolution of an image formed from such a toner is deteriorated.

The droplet diameter distribution represented by the ratio (dv/dp) of the volume average droplet diameter (dv) to the number average droplet diameter (dp) of the droplets of the monomer composition for core is generally 1.0 to 3.0, preferably 1.0 to 2.5, more preferably 1.0 to 2.0 on a plant-scale though it varies according to production scale. If the droplet diameter distribution of the droplets is too wide, the fixing temperature of the resulting polymerized toner varies, so that inconveniences such as fogging and toner filming tend to occur. The droplets preferably have a droplet diameter distribution that at least 30 vol. %, preferably at least 50 vol. % of the droplets are present within a range of (the volume average droplet diameter±1 μm).

In order to form fine droplets of the monomer composition for core, a stirrer capable of conducting high-shear stirring such as a TK type homomixer is generally used. Alternatively, a droplet-forming device equipped with a rotor which rotates on its axis at high speed, and a stator surrounding it and having small openings or comb-like teeth is used, and the aqueous dispersion medium containing the monomer composition is passed through between the rotor and the stator, whereby the monomer composition can be formed into droplets having a fine droplet diameter. As examples of such a droplet-forming device, may be mentioned Cleamix manufactured by M Technique K.K. and Ebara Milder manufactured by Ebara Corporation. The droplet diameter distribution of the droplets is narrowed by stirring the monomer composition for core by applying sufficient high shearing force thereto to disperse it. The droplet-forming time varies according to production scale. If the shearing time is too short in this droplet-forming step, or the droplet diameter distribution of the droplets is too wide, however, the formation of droplets having a uniform shape becomes insufficient, so that the spheroidicity of the resulting polymerized toner may be adversely affected in some cases.

The concentration of the polymerizable monomer for core in the aqueous dispersion medium is generally 5 to 40 wt. %, preferably 8 to 30 wt. %.

2. Step of Preparing Colored Polymer Particles

In the present invention, colored polymer particles which will become core particles are prepared by forming fine droplets of the monomer composition for core in the aqueous dispersion medium containing the dispersion stabilizer and then subjecting the monomer composition for core to suspension polymerization. In this case, it is preferred from the viewpoint of preventing the formation of scale and coarse particles in a polymerization reactor that the droplet-forming step should be conducted in a separate container, and the suspension containing the droplets obtained in the droplet-forming step be then charged into a polymerization reactor to conduct suspension polymerization. When the droplet-forming step and the suspension-polymerizing step are carried out in the same container, scale is easy to be formed.

The suspension polymerization is generally carried out by charging the suspension prepared in the droplet-forming step into a reactor equipped with a stirrer while controlling the reaction temperature. The reaction temperature is generally 5 to 120° C., preferably 30 to 120° C., more preferably 35 to 95° C. If the reaction temperature is too low, it is necessary to use a polymerization initiator high in catalytic activity, and so it is difficult to control the polymerization reaction. If the reaction temperature is too high, the additive components in the monomer composition for core, such as a parting agent, tend to bleed on each surface of the resulting colored polymer particles, so that the shelf stability of the resulting polymerized toner is deteriorated.

The suspension polymerization for obtaining the core particles is continued until the conversion of the polymerizable monomer into a polymer reaches generally at least 80%, preferably at least 85%, more preferably at least 90%. If the conversion is too low, a great amount of the polymerizable monomer for core remains unreacted, so that such a monomer is copolymerized with a polymerizable monomer for shell when the polymerizable monomer for shell is added to form a polymer layer, resulting in difficulty in forming any polymer layer (shell) having a sufficiently high Tg. When a difference in Tg between polymers formed from the polymerizable monomer for core and the polymerizable monomer for shell is small, the proportion of the polymerizable monomer for shell used is low, or higher shelf stability is required of the resulting polymerized toner, it is desirable that the suspension polymerization should be continued until the conversion of the polymerizable monomer for core reaches preferably at least 95%, more preferably at least 98%, particularly preferably at least 99%.

The volume average particle diameter (dv) of the colored polymer particles forming core particles is generally 0.1 to 20 μm, preferably 0.5 to 15 μm, more preferably 1 to 10 μm. The particle diameter distribution (dv/dp) represented by a ratio of the volume average particle diameter (dv) to the number average particle diameter (dp) of the colored polymer particles is generally at most 2.5, preferably at most 2.0, more preferably at most 1.7. In the case where a polymerized toner capable of achieving particularly high image quality is provided, the particle diameter distribution thereof can be reduced to preferably at most 1.5, particularly preferably at most 1.4. The lower limit of the particle diameter distribution is about 1.0. If the particle diameter distribution of the colored polymer particles is too wide, the particle diameter distribution of the resulting polymerized toner of a core-shell structure becomes too wide, resulting in difficulty in achieving high image quality.

3. Step of Forming Polymer Layer (Shell)

In the present invention, in order to provide the polymerized toner of the core-shell structure, a polymerizable monomer for shell is added to the reaction system in the presence of the colored polymer particles (A) prepared in the above-described step to form a polymer layer (B), which covers the colored polymer particles (A), using a polymerization initiator. In this shell-forming step, it is preferable to add the above-described water-soluble radical initiator as a polymerization initiator for shell.

The polymerizable monomer for shell is preferably added to and polymerized in the reaction system in the form of droplets smaller than the number average particle diameter of the colored polymer particles which will become core particles, since the droplets are easy to migrate into each surface of the core particles to form a polymer layer. In order to make the droplet diameter of the droplets of the polymerizable monomer for shell small, there may be mentioned, for example, a method in which a finely dispersing treatment is conducted by means of an ultrasonic emulsifier or the like in an aqueous dispersion medium.

In the present invention, a charge control agent can be mixed with the polymerizable monomer for shell, and the mixture can be then added to the reaction system to conduct polymerization, thereby improving the charge properties of the resulting polymerized toner.

As examples of a specific process for polymerizing the polymerizable monomer for shell in the presence of the core particles, may be mentioned a process in which the polymerizable monomer for shell is added to the reaction system of the polymerization reaction which has been conducted for obtaining the core particles, thereby continuously conducting the polymerization, and a process in which the core particles obtained in a separate reaction system are charged, to which the polymerizable monomer for shell is added, thereby conducting the polymerization stepwise. The polymerizable monomer for shell may be added to the reaction system in one lot, or continuously or intermittently by means of a pump such as a plunger pump.

In this step, it is preferable from the viewpoint of providing a polymerized toner in which an unreacted monomer remains only little that the polymerization reaction is continued until the conversion of the polymerizable monomer in the reaction system reaches generally at least 95%, preferably at least 98%, more preferably at least 99%.

Following the shell-forming step, the polymerized toner of the core-shell structure according to the present invention can be obtained. The average thickness of the shell (polymer layer) is generally 0.001 to 1 μm, preferably 0.003 to 0.5 μm, more preferably 0.005 to 0.2 μm. If the thickness of the shell is too great, the fixing ability of the polymerized toner is deteriorated. If the thickness is too small, the shelf stability of the polymerized toner is deteriorated. The thickness of the shell in the polymerized toner can be determined by directly measuring the shell thickness of each of particles selected at random from an electron photomicrograph thereof when it can be observed through an electron microscope. If it is difficult to clearly distinguish the core from the shell by observation through the electron microscope, the average thickness of the shell can be calculated out from the particle diameter of the core particles and the amount of the polymerizable monomer used for forming the shell.

Since the thickness of the shell is extremely small, the volume average particle diameter (dv) of the polymerized toner of the core-shell structure falls within a range of generally 0.1 to 20 μm, preferably 0.5 to 15 μm, more preferably 1 to 10 μm. The particle diameter distribution (dv/dp) represented by a ratio of the volume average particle diameter (dv) to the number average particle diameter (dp) of the polymerized toner is generally at most 2.5, preferably at most 2.0, more preferably at most 1.7. In the case where a polymerized toner capable of achieving particularly high image quality is provided, the particle diameter distribution thereof can be reduced to preferably at most 1.5, particularly preferably at most 1.4. The lower limit of the particle diameter distribution is about 1.0. If the particle diameter distribution of the polymerized toner is too wide, the resolution and gradation of an image formed with such a toner are lowered.

In the production process according to the present invention, the kinds and proportions of the individual components used, particularly, the kind and proportion of the crosslinkable monomer contained and used in the monomer composition for core, the kinds and proportions of additives used, such as the molecular modifier and parting agent, the polymerization process including the droplet-forming step, etc. are controlled, thereby forming polymer particles of a core-shell structure, which have the following features:

(1) the content of tetrahydrofuran-insoluble matter being 60 to 95 wt. %; and (2) the weight average molecular weight of tetrahydrofuran-soluble matter as determined by gel permeation chromatography being 50,000 to 400,000.

Developer

The polymerized toner according to the present invention may be used as a one-component developer as it is, or by externally adding a flowability-imparting agent thereto. However, the polymerized toner may also be used as a two-component developer by using it in combination with carrier particles if desired.

Examples of the external additives used in the production of a developer comprising the polymerized toner according to the present invention include inorganic particles and organic resin particles. Examples of the inorganic particles include particles of silicon dioxide, aluminum oxide, titanium oxide, zinc oxide, tin oxide, barium titanate and strontium titanate. Examples of the organic resin particles include particles of methacrylic ester polymers, acrylic ester polymers, styrene-methacrylic ester copolymers and styrene-acrylic ester copolymers, core-shell type particles in which a core is composed of a methacrylic ester copolymer, and a shell is composed of a styrene polymer, and core-shell type particles in which a core is composed of a styrene polymer, and a shell is composed of a methacrylic ester copolymer. Of these, the particles of the inorganic oxides, particularly, silicon dioxide particles are preferred. The surfaces of these particles can be subjected to a hydrophobicity-imparting treatment, and silicon dioxide particles subjected to the hydrophobicity-imparting treatment are particularly preferred. No particular limitation is imposed on the amount of the external additives used. However, it is generally about 0.1 to 6 parts by weight per 100 parts by weight of the polymerized toner particles. Two or more of the external additives may be used in combination.

The addition of the external additive is generally conducted by charging the external additive and the polymerized toner particles into a mixer such as a Henschel mixer to stir the resultant mixture. The external additive adheres to the surface of the polymerized toner. The external additive can enhance the flowability of the polymerized toner and also act as an abrasive, and so the formation of a toner film on a photosensitive member can be prevented.

An image forming apparatus, to which the polymerized toner according to the present invention is applied, generally comprises a photosensitive member, a means for charging the surface of the photosensitive member, a means for forming an electrostatic latent image on the surface of the photosensitive member, a means for containing a developer, a means for supplying the developer to develop the electrostatic latent image on the surface of the photosensitive member, thereby forming a toner image, and a means for transferring the toner image from the surface of the photosensitive member to a transfer medium.

EXAMPLES

The present invention will hereinafter be described more specifically by the following Examples and Comparative Examples. All designations of "part" or "parts" and "%" as will be used in the following examples mean part or parts by weight and wt. % unless expressly noted. Various physical properties and the like in the following examples were determined in accordance with the following respective methods.

(1) Content of THF-insoluble Matter (Gel Content)

One gram of a polymerized toner sample was precisely weighed and placed in an extraction thimble (86R, size: 28×100 mm, product of Toyo Filter Paper Co., Ltd.). The extraction thimble was placed in a Soxhlet extractor, and tetrahydrofuran as an extraction solvent was put into a flask placed on the lower part to conduct extraction for 6 hours in accordance with a method known per se in the art. After the extraction, the extraction solvent was recovered, and a soluble component extracted in the extraction solvent was separated by evaporation. The amount of extracted solids were then precisely weighed to calculate out a content (wt. %) of a THF-insoluble matter in the sample in accordance with the following equation:

$$\text{Content of THF-insoluble matter } (\%)=[(T\times P-S)/(T\times P)]\times 100$$

wherein

T: the amount (g) of the toner sample,

P: the proportion of components other than carbon black in the toner, and

S: the amount (g) of extracted solids.

(2) Weight Average Molecular Weight of THF-soluble Matter

A polymerized toner sample was dissolved in tetrahydrofuran to prepare a 1 wt. % sample solution. After the solution was filtered through a filter having a pore size of 0.45 μm, size exclusion chromatography was conducted under the following conditions, thereby determining the weight average molecular weight of THF-soluble matter in the sample using a calibration curve prepared from a standard sample of monodisperse polystyrene.

Column: KF-802, 803, 804, 805 (manufacterd by Shodex);

Detector: RI (polarity POS);

Flow rate: 1.0 ml/min,

Amount poured: 100 μl; and

Eluent: THF.

(3) Thickness of Shell

Although the thickness of shell can be measured by a Multisizer or through an electron microscope where the thickness of the shell is great, it was calculated out in accordance with the following equation where the thickness of the shell was thin like those in Examples and Comparative Examples:

$$\pi(r+x)^3/\pi r^3=1+(s/100\ \rho) \quad \text{(i)}$$

wherein r: the radius (μm) of core particles before addition of a polymerizable monomer for shell (a half of the volume average particle diameter of the core particles found from measurement by the Multisizer);

x: the thickness (μm) of shell;

s: the number of parts of the polymerizable monomer for shell added (per 100 parts by weight of a monomer for core); and ρ: the density (g/cm$^3$) of a polymer forming the shell.

The equation (i) is transformed into the equation (ii):

$$(x+r)/r=[1+(s/100\rho)]^{1/3} \quad \text{(ii)}$$

When ρ=1 is substituted into the equation (ii), the equation (iii) is obtained.

$$(x+r)/r=[1+(s/100)]^{1/3} \quad \text{(iii)}$$

From the equation (iii), the equation (iv) is derived.

$$x=r[1+(s/100)]^{1/3}-r \quad \text{(iv)}$$

The thickness of the shell was calculated out using the equation (iv).

(4) Glass Transition Temperature of Polymerized Toner

Five milligrams of a polymerized toner sample were precisely weighed in a P/N 52-023 PDC PAN (manufactured by Seiko Instruments Inc., 200 pcs/set) to conduct differential scanning calorimetry (DSC) using an SSC5200H thermal analysis system manufactured by Seiko Instruments Inc., thereby measuring the glass transition temperature of the sample. The measurement was conducted by heating the sample to 100° C. once, cooling it to 0° C., and then heating it from 0° C. to 100° C. at a heating rate of 10° C./min.

(5) Fixing Temperature

A commercially available printer (4 papers per minute printer) of a non-magnetic one-component development system was modified in such a manner that the temperature of a fixing roll can be varied. This modified printer was used to conduct a fixing test. The fixing test was carried out by varying the temperature of the fixing roll in the modified printer to determine the fixing rate of a developer sample at each temperature, thereby finding a relationship between the temperature and the fixing rate.

The fixing rate was calculated from a ratio between image densities before and after a peeling operation using an adhesive tape, which was conducted against a black solid-printed area of a test paper sheet printed by the modified printer. More specifically, assuming that the image density before the peeling of the adhesive tape is $ID_{before}$, and the image density after the peeling of the adhesive tape is $ID_{after}$, the fixing rate can be calculated out from the following equation:

$$\text{Fixing rate } (\%)=(ID_{after}/ID_{before})\times 100$$

The peeling operation of the adhesive tape is a series of operation that a pressure-sensitive adhesive tape (Scotch Mending Tape 810-3-18, product of Sumitomo 3M Limited) is applied to a measuring area of the test paper sheet to cause the tape to adhere to the sheet by pressing the tape under a fixed pressure, and the adhesive tape is then peeled at a fixed rate in a direction along the paper sheet. The image density was measured by means of a reflection image densitometer manufactured by McBeth Co.

In this fixing test, a temperature of the fixing roll at which a fixing rate of the developer amounted to 80% was defined as a fixing temperature of the developer.

(6) Offset Temperature

Black solid printing was conducted by varying a fixing temperature like the fixing temperature test to determine the offset temperature by whether offset occurred or not at that time. The offset resistance of a test sample is further excellent as a difference between this temperature and the fixing temperature becomes greater.

(7) Shelf Stability

Each developer sample was placed in a closed container to seal it, and the container was sunk into a constant-temperature water bath kept at a temperature of 55° C. The container was taken out of the constant-temperature water bath after 8 hours had elapsed, and the developer contained in the container was transferred to a 42-mesh sieve. At this time, the developer was quietly taken out of the container so as not to destroy the aggregate structure of the developer in the container, and carefully transferred to the sieve. The sieve was vibrated for 30 seconds by means of the above powder measuring device under conditions of vibration intensity of 4.5. The weight of the developer remaining on the sieve was then measured to regard it as the weight of the developer aggregated. A proportion (wt. %) by weight of the aggregated developer to the weight of the developer first put into the container was calculated out. The measurement was conducted 3 times on one sample to use the average value thereof as an index to the shelf stability.

Example 1

(1) Preparation of Monomer Composition for Core

A polymerizable monomer mixture (calculated Tg of the resulting copolymer=55° C.) for core composed of 80.5 parts of styrene and 19.5 parts of n-butyl acrylate, 0.3 parts of a polymethacrylic ester macromonomer ("AA6"; Tg=94° C.; product of Toagosei Chemical Industry Co., Ltd.), 0.5 parts of divinylbenzene, 1.2 parts of t-dodecylmercaptan, 7 parts of carbon black ("#25B", trade name; product of Mitsubishi Kagaku Co., Ltd.), 1 part of a charge control agent ("Spiron Black TRH", trade name; product of Hodogaya Chemical Co., Ltd.), and 2 parts of a parting agent (natural gas type Fischer-Tropsch wax, "FT-100", trade name; product of Shell MDS Co.; melting point: 92° C.) were subjected to wet grinding by means of a media type wet grinding machine to obtain a monomer composition for core.

(2) Preparation of Aqueous Dispersion Medium Containing Dispersion Stabilizer

An aqueous solution with 6.2 parts of sodium hydroxide (alkali metal hydroxide) dissolved in 50 parts of ion-exchanged water was gradually added to an aqueous solution with 10.2 parts of magnesium chloride (water-soluble polyvalent metallic salt) dissolved in 250 parts of ion-exchanged water under stirring to prepare an aqueous dispersion medium containing magnesium hydroxide colloid (colloid of hardly water-soluble metal hydroxide).

The particle diameter distribution of the colloid formed was measured by means of a microtrack particle diameter distribution measuring device (manufactured by Nikkiso Co., Ltd.) and found to be 0.35 μm in terms of $D_{50}$ (50% cumulative value of number particle diameter distribution) and 0.84 μm in terms of $D_{90}$ (90% cumulative value of number particle diameter distribution). The measurement by means of the microtrack particle diameter distribution measuring device was performed under the following conditions:

measuring range: 0.12 to 704 μm;

measuring time: 30 seconds; and medium: ion-exchanged water.

(3) Preparation of Polymerizable Monomer for Shell

Three parts of methyl methacrylate (calculated Tg of the resulting polymer=105° C.) and 100 parts of water were subjected to a finely dispersing treatment by an ultrasonic emulsifier, thereby obtaining an aqueous dispersion of a polymerizable monomer for shell. The droplet diameter of droplets of the polymerizable monomer for shell was found to be 1.6 μm in terms of $D_{90}$ as determined by means of the microtrack particle diameter distribution measuring device by adding the droplets of the monomer at a concentration of 3% to a 1% aqueous solution of sodium hexametaphosphate.

(4) Droplet-forming Step

The monomer composition for core obtained in the step (1) was poured into the colloidal dispersion of magnesium hydroxide obtained in the step (2), the mixture was stirred until droplets became stable, and 6 parts of t-butyl peroxy-2-ethylhexanoate ("Perbutyl O", product of Nippon Oil & Fats Co., Ltd.) was added as a polymerization initiator thereto. Thereafter, the resultant dispersion was stirred for 30 minutes at 15,000 rpm under high shearing force by means of an Ebara Milder MDN 303V model (manufactured by Ebara Corporation) to form droplets of the monomer composition for core.

At the time a conversion into a polymer reached almost 100% after the aqueous dispersion containing the droplets of the monomer composition for core was charged into a 10-liter reactor equipped with a agitating blade to initiate a polymerization reaction at 85° C., sampling was conducted to measure the average particle diameter of the resultant colored polymer particles (core particles). As a result, the volume average particle diameter of the core particles was found to be 7.0 μm.

The reactor was charged with the aqueous dispersion of the polymerizable monomer for shell and a solution with 0.3 parts of 2,2'-azobis[2-methyl-N-(2-hydroxyethyl) propionamide] ("VA-086", trade name; product of Wako Pure Chemical Industries, Ltd.) as a water-soluble initiator dissolved in 65 parts of distilled water. After the polymerization was continued for 4 hours, the reaction was stopped to obtain a reaction mixture having a pH of 9.5. While stirring the reaction mixture, sulfuric acid was added to adjust the pH to about 5.0 to conduct acid washing (at 25° C. for 10 minutes). The thus-treated reaction mixture was then filtered and dehydrated. After the dehydration, washing water was sprayed on the residue to conduct water washing. Thereafter, the thus-treated residue was dried for 2 days by a dryer (at 45° C.) to obtain polymer particles of a core-shell structure. The content (gel content) of THF-insoluble matter in the resultant polymer particles (polymerized toner) was 64 wt. %, and the weight average molecular weight of THF-soluble matter was 230,000.

To 100 parts of the polymer particles obtained above were added 0.8 parts of silica ("R-202", trade name; product of Degussa AG) having an average particle diameter of 14 nm subjected to a hydrophobicity-imparting treatment, and they were mixed by means of a Henschel mixer to prepare a non-magnetic one-component developer. The physical properties of the polymerized toner and developer thus obtained are shown in Table 1.

Example 2

A polymerized toner and a developer were obtained in the same manner as in Example 1 except that the amounts of divinylbenzene and t-dodecylmercaptan were changed from 0.5 parts and 1.2 parts in Example 1 to 0.8 parts and 1.75 parts, respectively. The gel content in the resultant polymerized toner was 86%, and the weight average molecular weight of THF-soluble matter was 160,000. The results are shown in Table 1.

Comparative Example 1

A polymerized toner and a developer were obtained in the same manner as in Example 1 except that the amount of divinylbenzene was changed from 0.5 parts in Example 1 to 0.4 parts. The gel content in the resultant polymerized toner was 54%, and the weight average molecular weight of THF-soluble matter was 200,000. The results are shown in Table 1.

Comparative Example 2

A polymerized toner and a developer were obtained in the same manner as in Example 1 except that the amounts of divinylbenzene and t-dodecylmercaptan were changed from 0.5 parts and 1.2 parts in Example 1 to 0.7 parts and 1.0 part, respectively. The gel content in the resultant polymerized toner was 97%, and the weight average molecular weight of THF-soluble matter was 280,000. The results are shown in Table 1.

Comparative Example 3

A polymerized toner and a developer were obtained in the same manner as in Example 1 except that the amount of t-dodecylmercaptan was changed from 1.2 parts in Example 1 to 0.7 parts. The gel content in the resultant polymerized toner was 72%, and the weight average molecular weight of THF-soluble matter was 440,000. The results are shown in Table 1.

TABLE 1

| | Example | | Comparative Example | | |
|---|---|---|---|---|---|
| | 1 | 2 | 1 | 2 | 3 |
| Monomer composition for core (part): | | | | | |
| Styrene | 80.5 | 80.5 | 80.5 | 80.5 | 80.5 |
| n-Butyl acrylate | 19.5 | 19.5 | 19.5 | 19.5 | 19.5 |
| Macromonomer | 0.3 | 0.3 | 0.3 | 0.3 | 0.3 |
| Divinylbenzene | 0.5 | 0.8 | 0.4 | 0.7 | 0.5 |
| t-Dodecylmercaptan | 1.2 | 1.75 | 1.2 | 1.0 | 0.7 |
| Carbon black | 7.0 | 7.0 | 7.0 | 7.0 | 7.0 |
| Parting agent | 2.0 | 2.0 | 2.0 | 2.0 | 2.0 |
| Charge control agent | 1.0 | 1.0 | 1.0 | 1.0 | 1.0 |

TABLE 1-continued

| | Example | | Comparative Example | | |
|---|---|---|---|---|---|
| | 1 | 2 | 1 | 2 | 3 |
| Monomer for shell (part): | | | | | |
| Methyl methacrylate | 3.0 | 3.0 | 3.0 | 3.0 | 3.0 |
| Polymerized toner: | | | | | |
| Volume average particle diameter (μm) | 7.1 | 7.1 | 7.1 | 7.0 | 7.0 |
| Shell thickness (μm) | 0.035 | 0.035 | 0.035 | 0.035 | 0.035 |
| Glass transition temperature (° C.) | 55 | 56 | 54 | 58 | 58 |
| Content of THF-insoluble matter (%) | 64 | 86 | 54 | 97 | 72 |
| Weight average molecular weight of THF-soluble matter ($\times 10^4$) | 23 | 16 | 20 | 28 | 44 |
| Physical properties of developer: | | | | | |
| Fixing temperature (° C.) | 120 | 125 | 115 | 160 | 150 |
| Offset temperature (° C.) | 180 | 190 | 150 | 200 | 210 |
| Shelf stability (%) | 1 | 2 | 6 | 2 | 1 |

(Note)

(1) Parting agent: Fischer-Tropsch wax (FT-100, trade name; product of Shell MDS Co., melting point: 92° C.)

(2) Charge control agent: "Spiron Black TRH" (trade name, product of Hodogaya Chemical Co., Ltd.)

(3) Content of THF-insoluble matter: the proportion (gel content) of tetrahydrofuran-insoluble matter in each polymerized toner (4) Weight average molecular weight: the weight average molecular weight of tetrahydrofuran-soluble matter in each polymerized toner.

As apparent from the results shown in Table 1, the polymerized toners of a core-shell structure (Examples 1 and 2), wherein (1) the content of THF-insoluble matter is 60 to 95 wt. %, and (2) the weight average molecular weight of tetrahydrofuran-soluble matter as determined by gel permeation chromatography is 50,000 to 400,000, are low in fixing temperature, high in offset temperature and excellent in shelf stability, and provide developers balanced among development properties at a high level. The polymerized toners according to the present invention are excellent in low-temperature fixing ability and hence can meet the speeding-up of printing and the formation of full-color images. In addition, since the polymerized toners according to the present invention are relatively high in offset temperature, an offset phenomenon can be effectively prevented, and a range of printing temperature is also wide. Further, since the polymerized toners according to the present invention are excellent in shelf stability, and so a blocking phenomenon can be effectively inhibited, changes in image quality after continuous printing or long-term printing are also prevented.

On the other hand, when the content of THF-insoluble matter (gel content) is too low (Comparative Example 1), the offset temperature becomes low to deteriorate the offset resistance, and besides such a developer shows a tendency to deteriorate its shelf stability. When the content of THF-insoluble matter (gel content) is too high (Comparative Example 2), the fixing temperature becomes high, and so it is difficult to meet the speeding-up of printing and the formation of full-color images. When the weight average molecular weight of the THF-soluble matter as determined by GPC is too high (Comparative Example 3), the fixing temperature becomes high, and so the same inconveniences as described above occur.

INDUSTRIAL APPLICABILITY

According to the present invention, there are provided toners for development of electrostatic images, which are excellent in low-temperature fixing ability, offset resistance and shelf stability. The polymerized toners according to the present invention have a low fixing temperature, can meet the speeding-up of printing, are suitable for use as color toners, and have a high offset temperature and excellent shelf stability. Therefore, when the polymerized toners of the core-shell structure according to the present invention can be used as developers, they can be suitably used in various kinds of printers and copying machines of an electrophotographic system, since they are excellent in printing properties, can be fixed at a temperature lower than the conventional fixing temperature, have excellent fixing ability even in high-speed printing or copying and cause no color irregularity even in color printing or copying.

What is claimed is:

1. A polymerized toner of a core-shell structure comprising colored polymer particles (A) containing a colorant, and a polymer layer (B) covering the colored polymer particles (A), wherein the polymerized toner has the following features:

(1) the content of tetrahydrofuran-insoluble matter being 60 to 95 wt. %; and (2) the weight average molecular weight of tetrahydrofuran-soluble matter as determined by gel permeation chromatography being 50,000 to 400,000.

2. The polymerized toner according to claim 1, wherein the volume average particle diameter of the toner is 0.1 to 20 μm, and the average thickness of the polymer layer (B) is 0.001 to 1 μm.

3. The polymerized toner according to claim 1, wherein the glass transition temperature (Tg-A) of a polymer component forming the colored polymer particles (A) is at most 60° C., and the glass transition temperature (Tg-B) of a polymer component forming the polymer layer (B) is higher by at least 10° C. than the glass transition temperature (Tg-A).

4. The polymerized toner according to claim 1, wherein the colored polymer particles (A) further comprise a parting agent.

5. The polymerized toner according to claim 4, wherein the parting agent is at least one selected from the group consisting of polyfunctional ester compounds, low molecular weight olefins, paraffin waxes and synthetic waxes.

6. The polymerized toner according to claim 5, wherein the parting agent is Fischer-Tropsch wax which is a synthetic wax.

7. The polymerized toner according to claim 1, which is obtained by forming fine droplets of a monomer composition for core, which contains at least a polymerizable monomer for core and a colorant, in an aqueous dispersion medium containing a dispersion stabilizer, subjecting the monomer composition to suspension polymerization in the presence of a polymerization initiator to form the colored polymer particles (A) and then subjecting a polymerizable monomer for shell to suspension polymerization in the presence of the colored polymer particles (A) to form the polymer layer (B).

8. The polymerized toner according to claim 7, wherein a weight ratio of the polymerizable monomer for core to the polymerizable monomer for shell is 80:20 to 99.9:0.1.

9. The polymerized toner according to claim 7, wherein the polymerizable monomer for core is adapted to form a polymer having a glass transition temperature (Tg-A) of at most 60° C., and the polymerizable monomer for shell is adapted to form a polymer having a glass transition temperature (Tg-B) higher by at least 10° C. than the glass transition temperature (Tg-A).

10. The polymerized toner according to claim 7, wherein the monomer composition for core further comprises a parting agent in a proportion of 0.1 to 20 parts by weight per 100 parts by weight of the polymerizable monomer for core.

11. The polymerized toner according to claim 7, wherein the monomer composition for core further comprises a crosslinkable monomer in a proportion of 0.1 to 3 parts by weight per 100 parts by weight of the polymerizable monomer for core.

12. The polymerized toner according to claim 7, wherein the monomer composition for core further comprises a macromonomer having a glass transition temperature of at least 80° C. in a proportion of 0.01 to 1 part by weight per 100 parts by weight of the polymerizable monomer for core.

13. The polymerized toner according to claim 7, wherein the monomer composition for core further comprises a molecular weight modifier in a proportion of 0.01 to 10 parts by weight per 100 parts by weight of the polymerizable monomer for core.

14. The polymerized toner according to claim 7, wherein the dispersion stabilizer is a hardly water-soluble, inorganic dispersing agent.

15. A process for producing a polymerized toner of a core-shell structure comprising colored polymer particles (A) containing a colorant, and a polymer layer (B) covering the colored polymer particles (A), said process comprising the steps of forming fine droplets of a monomer composition for core, which contains at least a polymerizable monomer for core and a colorant, in an aqueous dispersion medium containing a dispersion stabilizer, subjecting the monomer composition to suspension polymerization in the presence of a polymerization initiator to form the colored polymer particles (A) and then subjecting a polymerizable monomer for shell to suspension polymerization in the presence of the colored polymer particles (A) to form the polymer layer (B) which covers each of the colored polymer particles (A), thereby forming polymer particles having a core-shell structure, which have the following features:

(1) the content of tetrahydrofuran-insoluble matter being 60 to 95 wt. %; and (2) the weight average molecular weight of tetrahydrofuran-soluble matter as determined by gel permeation chromatography being 50,000 to 400,000.

16. The production process according to claim 15, wherein the monomer composition for core further comprises, per 100 parts by weight of the polymerizable monomer for core, 0.1 to 20 parts by weight of a parting agent, 0.1 to 3 parts by weight of a crosslinkable monomer, and 0.01 to 10 parts by weight of a molecular weight modifier.

17. The production process according to claim 15, wherein the monomer composition for core further comprises a macromonomer having a glass transition temperature of at least 80° C. in a proportion of 0.01 to 1 part by weight per 100 parts by weight of the polymerizable monomer for core.

18. The production process according to claim 15, wherein a weight ratio of the polymerizable monomer for core to the polymerizable monomer for shell is 80:20 to 99.9:0.1.

19. The production process according to claim 15, wherein the polymerizable monomer for core is adapted to form a polymer having a glass transition temperature (Tg-A) of at most 60° C., and the polymerizable monomer for shell is adapted to form a polymer having a glass transition temperature (Tg-B) higher by at least 10° C. than the glass transition temperature (Tg-A).

20. The production process according to claim 15, wherein the dispersion stabilizer is a hardly water-soluble, inorganic dispersing agent.

21. The polymerized toner according to claim 1, wherein the content of tetrahydrofuran-insoluble matter is from higher than 60 wt. % to 95 wt. %.

22. The production process according to claim 15, wherein the content of tetrahydrofuran-insoluble matter is from higher than 60 wt. % to 95 wt. %.

* * * * *